United States Patent [19]

Bilek

[11] 4,322,044

[45] Mar. 30, 1982

[54] PAPER ALIGNMENT AND LOADING APPARATUS

[75] Inventor: F. Thomas Bilek, Plano, Tex.

[73] Assignee: Texas Instruments Incorporated, Dallas, Tex.

[21] Appl. No.: 161,844

[22] Filed: Jun. 23, 1980

[51] Int. Cl.[3] ..... B65H 23/06; B65H 17/02

[52] U.S. Cl. ..... 242/75.4; 242/67.3 R; 400/120; 400/614

[58] Field of Search ..... 242/67.3 R, 75.4, 75.91, 242/67.1 R; 400/120, 614, 614.1; 346/76, 76 PH

[56] References Cited

U.S. PATENT DOCUMENTS

| | | | |
|---|---|---|---|
| 3,845,850 | 11/1974 | Herr | 400/120 |
| 3,848,720 | 11/1974 | Carlsen | 400/120 |
| 4,004,749 | 1/1977 | Strange | 242/75.4 |
| 4,260,116 | 4/1981 | Collin | 242/67.3 R |

*Primary Examiner*—Edward J. McCarthy
*Attorney, Agent, or Firm*—Thomas G. Devine; Rhys Merrett; Mel Sharp

[57] ABSTRACT

A continuous paper web-moving mechanism has a supply roll on which the paper is wound and pulled from the supply roll by a drive roll that engages the paper on its surface by a pressure exerted against the paper at that point. In this preferred embodiment the pressure is exerted by a thermal printhead resiliently mounted to force the paper against the drive roll. A leaf spring is mounted at one end of the drive roll, bearing against the edge of the wound paper, providing a friction drag on the drive roll. Also, the drive roll is kept in a fixed lateral position by the force of the leaf spring, aiding in aligning the paper. The tension between the supply roll and the drive roll is such that the paper is stiffened, providing a contact with the surface of the drive roller in a tangential line.

18 Claims, 3 Drawing Figures

PAPER ALIGNMENT AND LOADING APPARATUS

BACKGROUND OF THE INVENTION

1. Field of the Invention

This invention relates to continuous web-moving apparatus and in particular to thermally sensitive paper alignment and moving apparatus for printing thereon by a thermal printhead.

2. Description of the Prior Art

Continuous paper web-moving apparatus has been implemented with sprocket drives that involve levers, pawls and friction drives, all working in combination to keep the paper in alignment, generally for printing thereon. Such systems require relatively high cost and continuous adjustments.

Other systems use pinch roller techniques where the skew of paper is controlled by adjusting the pressure of the pinch on the paper at each each end of the driving pinch roller. In another system, the skew is adjusted by adjusting the pinch roller pressure at each end of the driven paper (This is the typical method of driving paper rolls in news print presses). In this latter prior art system, when the pinching pressure is light, the drive roller diameter must be large and the paper is then driven at a faster rate, moving toward the heavier pinching pressure.

This technique can be applied only to a limited degree with respect to a thermal line printer because of an out-of-round condition in the thermal printer caused by the force required between the printhead and the thermal paper to sufficiently heat the thermal paper. In the prior art system, the force applied across the printhead must be precisely uniform and the diameter of the print roll must remain substantially constant.

This invention reduces or eliminates these prior art disadvantages by maintaining the paper in tension between the supply roll and the drive roll to an extent that the paper is stiffened.

BRIEF SUMMARY OF THE INVENTION

A thermal paper web alignment and moving device is built on a frame having a fixed wall at one side thereof. A supply roll, upon which thermal paper is wound, has an axle at one end which is supported in a bearing in the fixed wall, the other end of which is supported in a bearing in a leaf spring attached to the frame, frictionally bearing against the edge of the wound paper. A drive roll, which in this preferred embodiment serves as a platen, has an axle to which is attached a drive gear at one end, the one end terminating in a bearing within the fixed wall, the other end terminating in a bearing in the frame. The paper is held snugly against the drive roll by a line thermal printhead, held against the paper and drive roll by a pair of springs. A stepper motor is mechanically connected to the gear attached to the drive roller to turn the drive roller.

The tension caused by the frictional force of the leaf spring bearing against the wound paper on the supply roll and the turning of the drive roller stiffens the paper providing a minimum surface area contacting the drive roller. The leaf spring pressure serves also to maintain the supply roll in a fixed position, thus aiding in aligning the stiffened paper. It is at the point of contact with the drive roll that the thermal printhead contacts the paper and the printing is accomplished. The pressure between the printhead and the drive roller provides the force necessary to remove paper from the supply roll.

It has been found that a resilient platen provides a good surface for thermal printing and therefore a resilient drive roller is employed in this invention. The distortion of the resilient material of the drive roller is not of consequence because of the stiffened paper as will be described in detail later.

The paper, after leaving the printing station is taken up on a take-up roll which is turned by a continuously operating hysteresis, synchronous motor. When the stepper motor is stopped, the take-up roll tends to continue turning but the torque of the driving synchronous motor is such that it is readily stalled under that condition and remains in a stalled rotor state until the drive motor is again turned on.

The principle object of this invention is to provide a continuous web-moving apparatus that requires a minimum of structure for attaining satisfactory alignment.

Another object of this invention is to provide an economical and accurate continuous paper web alignment and moving apparatus for printing thereon.

Still another object of this invention is to provide a continuous thermally sensitive paper web alignment and moving apparatus for moving the thermally sensitive paper in alignment and contact with a line thermal printhead for thermally printing thereon.

These and other objects will be evident in the detailed description that follows.

DETAILED DESCRIPTION OF THE INVENTION

Figure 1:
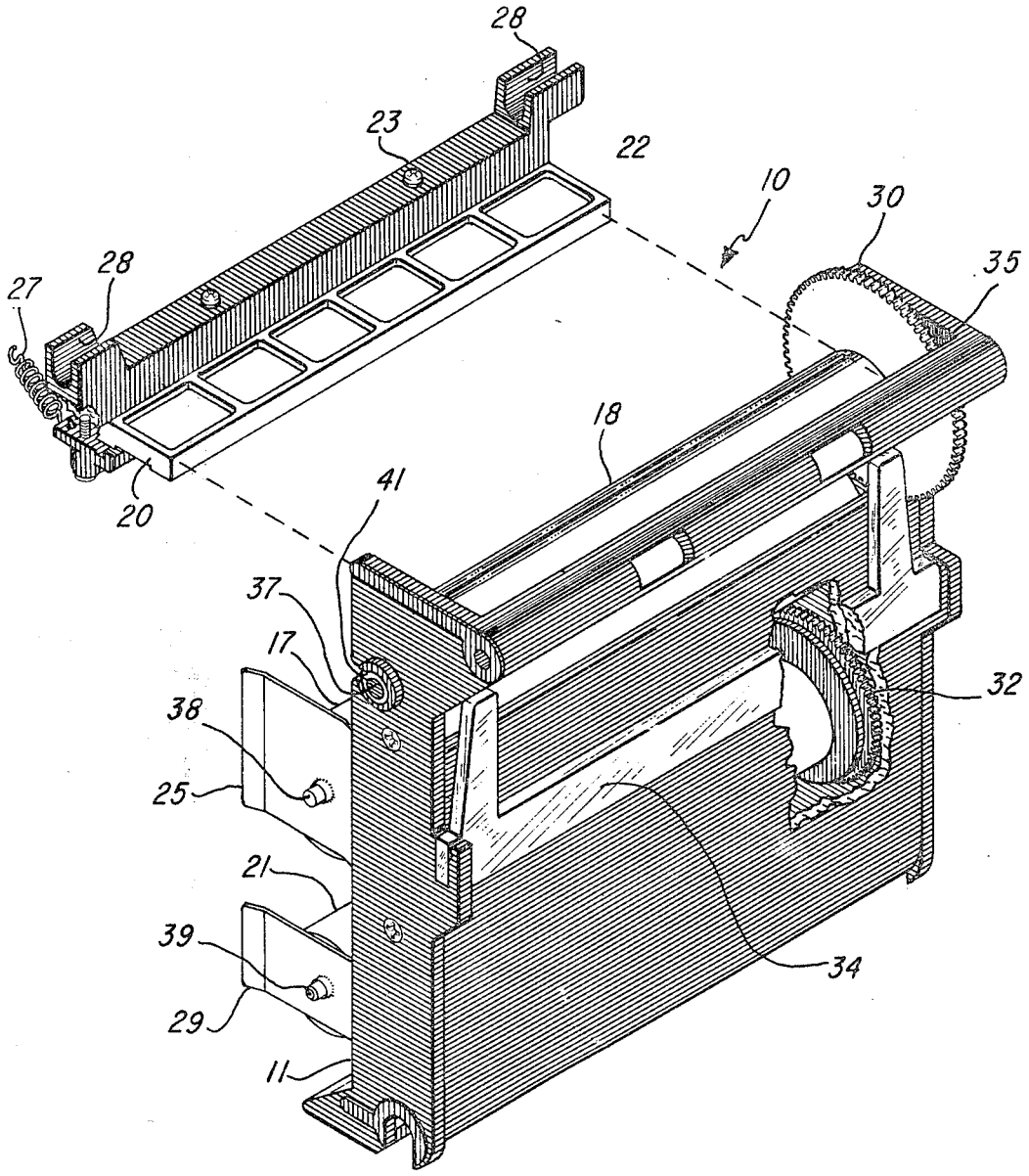
FIG. 1 is an exploded isometric view of the web-moving mechanism.

FIG. 1 illustrates continuous web-moving apparatus 10. Frame 11 has a fixed wall 35 which serves, in part, to guide the web. In this preferred embodiment, the web is a thermally sensitive paper, but of course could be any other sheet material. A thermal line printer 20 is affixed to the bottom of the bracket 22 which in turn is attached to bracket 23. This assembly is inserted into place as shown with the thermal printhead pressing against the drive roll 18. Spring 27 is attached to the bracket 22 and to an anchor (not shown) to cause the head 20 to pivot around axis 28 in a downwardly direction to pinch the paper 19 (see FIGS. 2 and 3) against the drive roller 18. Another spring (not shown) is located at the other end of bracket 22 and aids spring 27.

Figure 3:
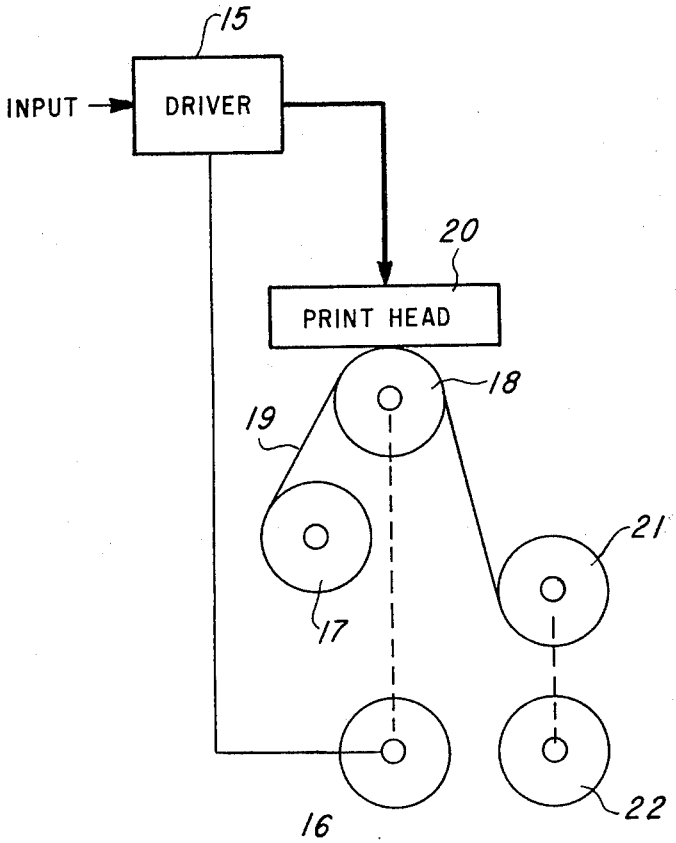
FIG. 3 diagramatically illustrates the components of the web-moving apparatus.

Drive roller 18 is connected to gear 30 which is engaged by stepping motor 16 (FIG. 3). Drive roller 18 is made of a resilient material which, in this preferred embodiment, works well in conjunction with the thermal line printer 20. Drive roll 18, which serves as a platen in this particular embodiment, has an axle 37 which is rotatably mounted in bearing 41 in frame 11. Axle 37 is also rotatably mounted in a similar bearing in the fixed wall 35.

Supply roll 17 has an axle 38 which passes through a bearing surface in spring 25. The other end of axle 38 terminates in a bearing in fixed wall 35. Leaf spring 25, attached to frame 11, serves a very important function by exerting frictional force against the paper wound on supply roll 17. When stepper motor 16 is turned on, turning gear 30 and drive roll 18, the paper from supply roll 17, as a result of the frictional pressure from leaf spring 25, comes under tension. The tension causes the paper 19 to stiffen between the supply roll and the junction of the head 20 and drive roll 18.

Take-up roll 21 has axle 39 terminating in a bearing surface in spring 29 at one end and having gear 32 attached at the other end, which terminates in a bearing and fixed wall 35. Gear 32 is rotated by hysteresis, synchronous motor 22 (FiG. 3) which operates continuously. Motor 22 has a torque selected so that when stepper motor 16 is stopped, the rotor of motor 22 is stalled until such time as stepper motor 16 is again activated. Motor 22 is designed to remain in a stalled rotor condition indefinitely as is any hysteresis, synchronous motor. Spring 29 does not bear against the paper wound on take-up roll 21 but is simply present to enable easy removal and installation of take-up roll 21.

Paper tear bar 34 enables the user to tear the paper whenever desired and to then remove the take-up roll. He may examine the printed matter from the thermal printhead 20. In this preferred embodiment, the printed matter illustrates traces and annotations thereto representative of monitored parameters. The continuous web-moving apparatus of this preferred embodiment is in fact incorporated in a fixed thermal printhead solid state chart recorder which is the subject of a copending patent application Ser. No. 156,455 filed on June 4, 1980, entitled "Solid State Recorder" and assigned to the assignee of this invention.

Figure 2:
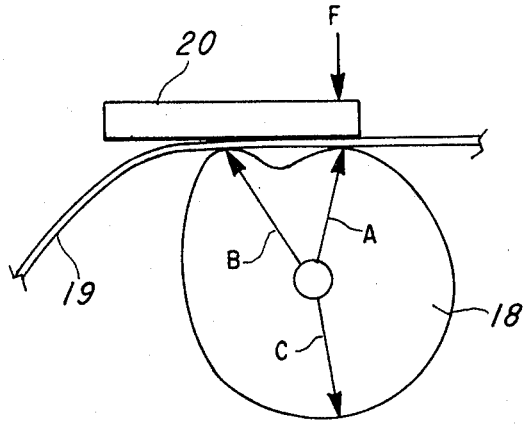
FIG. 2 illustrates, in exaggerated form, the deformation of the drive roller and the contacting of the paper under the head.

FIG. 2 illsutrates head 20 forced down with a force F by springs 27 onto paper 19 which in turn is forced into contact with drive roll 18 which is deformed because of its resilient material makeup. Three radii a, b and c are shown to represent the conditions resulting from this distortion, radius a is created by compressing drive roller 18 with force F. Radius b, which is larger than radius a or radius c is caused by the compressability of the resilient material, causing it to be forced away from the target point where head 20 contacts paper 19. Radius c is the normal radius. Radii a and b attempt to drive paper 19 at different speeds because of their different dimensions from the normal radius c. If paper 19 were dependent on all three of these radii for activation, it is apparent that its speed would be unstable. By maintaining paper 19 in tension between the supply roll 17 and drive roll 18, paper 19 is stiffened and contact with drive roll 18 is minimized so that the distortion is not appreciably noticed. That is, the contact between paper 19 and drive roll 18 is almost in a tangential line. In this manner, the head 20 is pressed firmly by force F against paper 19 which in turn presses against the distorts drive roll 18.

FIG. 3 graphically illustrates a driver 15 which provides printing information to printhead 20 and rotational information to stepper motor 16. Stepper motor 16 is shown mechanically coupled to drive roll 18 over which paper 19 passes and which is pinched against drive roll 18 by printhead 20. This pinching force causes paper 19 to be pulled from supply roll 17 and to be taken up on take-up roll 21. Hysteresis, synchronous motor 22 is shown mechanically coupled to turn take-up roll 21.

MODE OF OPERATION

Referring to the three FIGURES, a supply roll 17 with paper wound thereon is inserted in place between spring 25 and fixed wall 35. The paper is passed between head 20 and drive roll 18, under tear bar 34 and onto take-up roll 21. Driver 15 applies phase information to stepper motor 16 which then engages gear 30, turning drive roll 18. The pinching action between head 20 and drive roll 18 forces the paper to move. Print information is provided to head 20 which contains a plurality of individually actuable heating elements for thermal printing on paper 19. Hysteresis, synchronous motor 22 attempts to continually turn take-up reel 21, taking the paper as it is recorded, and winding it on the take-up reel 21. If recording is stopped by stopping the stepper motor 16, hysteresis motor 22, as described above, simply stalls until such time as the stepper motor is again enabled.

Those skilled in the art readily understand that this invention covers web-moving apparatus for use in a multitude of devices, such as printing presses, impact line printers and the like. It is not limited to thermal printing nor to use in strip chart recorders. The scope and breadth of the invention is limited only by the appended claims.

I claim:

1. Continuous web-moving apparatus selectively activated by drive means, comprising:

(a) a frame having a fixed wall formed at one side thereof;

(b) supply roll means on which the web is wound, rotatably mounted in the frame, one end thereof being rotatably positioned against the fixed wall;

(c) drive roll means over which the web passes, rotatably mounted on the frame, one end thereof being rotatably positioned against the fixed wall, and being mechanically connected to be rotated by the drive means;

(d) pressure means positioned on the frame to force the web against the drive roll means to move the web when the drive means is activated; and (e) drag means, positioned on the frame adjacent to the supply roll means to frictionally engage the web causing web tension between the supply roll means and the drive roll means thereby stiffening the web therebetween.

2. The apparatus of claim 1 further comprising:

(f) take-up roll means rotatably mounted on the frame for winding the web thereon after passing between the drive roll means and the pressure means; and (g) take-up motor means mechanically connected to the take-up roll means for continuously rotating the take-up roll, having a torque that permits a stalled rotor condition when the drive means is inactivated.

3. The apparatus of claim 1 wherein the supply roll means comprises a cylinder having an axle terminating in a bearing surface in the fixed wall at one end, and a bearing surface in the drag means at the other end.

4. The apparatus of claim 1 wherein the drive roll means comprises a cylinder having an axle and a drive gear affixed to one end of the axle, the one end of the axle terminating in a bearing surface in the fixed wall, and in a bearing surface in the frame at the other end.

5. The apparatus of claim 3 wherein the drive roll means comprises a cylinder having an axle and a drive gear affixed to one end of the axle, the one end of the axle terminating in a bearing surface in the fixed wall, and in a bearing surface in the frame at the other end.

6. The apparatus of claim 5 wherein the drive roll means comprises a resilient material.

7. The apparatus of claim 3 wherein the drag means comprises a leaf spring positioned to bear frictionally against the edge of the wound web.

8. The apparatus of claim 6 wherein the drag means comprises a leaf spring positioned to bear frictionally against the edge of the wound web.

9. The apparatus of claim 8 further comprising:

(f) take-up roll means rotatably mounted on the frame for winding the web thereon after passing between the drive roll means and the pressure means; and (g) take-up motor means mechanically connected to the take-up means for continuously rotating the take-up roll having a torque that permits a stalled rotor condition when the drive means is inactivated.

10. Thermally-sensitive paper alignment and moving apparatus selectively activated by a drive motor, comprising:

(a) a frame having a fixed wall formed at one side thereof;

(b) supply roll means on which the paper is wound, rotatably mounted in the frame, one end thereof being rotatably positioned against the fixed wall;

(c) drive roll means over which the paper passes, rotatably mounted on the frame, one end thereof being rotatably positioned against the fixed wall and being mechanically connected to be rotated by the drive means;

(d) thermal printhead means positioned on the frame to force the paper against the drive roll means to move the paper when the drive means is activated, and at least one spring connected to the printhead and to the frame to force the printhead into thermal contact with the thermally sensitive paper; and (e) drag means, positioned on the frame adjacent the supply roll means to frictionally engage the paper, causing paper tension between the supply roll means and the drive roll means, thereby stiffening the paper therebetween.

11. The apparatus of claim 10 further comprising:

(f) take-up roll means rotatably mounted on the frame for winding the paper thereon after passing between the drive roll means and the printhead; and (g) take-up motor means mechanically connected to the take-up roll means for continuously rotating the take-up roll, having a torque that permits a stalled rotor condition when the drive means is inactivated.

12. The apparatus of claim 10 wherein the supply roll means comprises a cylinder having an axle terminating in a bearing surface in the fixed wall at one end and in a bearing surface in the drag means at the other end.

13. The apparatus of claim 10 wherein the drive roll means comprises a cylinder having an axle and a drive gear affixed to one end of the axle, the one end of the axle terminating in a bearing surface in the fixed wall and in a bearing surface in the frame at the other end.

14. The apparatus of claim 12 wherein the drive roll means comprises a cylinder having an axle and a drive gear affixed to one end of the axle, the one end of the axle terminating in a bearing surface in the fixed wall and in a bearing surface in the frame at the other end.

15. The apparatus of claim 14 wherein the drive roll means comprises a resilient material.

16. The apparatus of claim 12 wherein the drag means comprises a leaf spring positioned to bear frictionally against the edge of the wound paper.

17. The apparatus of claim 15 wherein the drag means comprises a leaf spring positioned to bear friction against the edge of the wound paper.

18. The apparatus of claim 17 further comprising:

(f) take-up roll means rotatably mounted on the frame for winding the paper thereon after passing between the drive roll means and the printhead; and (g) take-up motor means mechanically connected to the take-up roll means for continuously rotating the take-up roll means having a torque that permits a stalled rotor condition when the drive means is inactivated.

* * * * *